US008985024B2

(12) United States Patent
Yang et al.

(10) Patent No.: US 8,985,024 B2
(45) Date of Patent: Mar. 24, 2015

(54) SHAPED CHARGE LINER

(75) Inventors: Wenbo Yang, Sugar Land, TX (US); James Guilkey, Salt Lake City, UT (US)

(73) Assignee: Schlumberger Technology Corporation, Sugar Land, TX (US)

( * ) Notice: Subject to any disclaimer, the term of this patent is extended or adjusted under 35 U.S.C. 154(b) by 109 days.

(21) Appl. No.: 13/530,545

(22) Filed: Jun. 22, 2012

(65) Prior Publication Data

US 2013/0340643 A1 Dec. 26, 2013

(51) Int. Cl.
*F42B 1/032* (2006.01)
*F42B 1/036* (2006.01)
*F42B 12/10* (2006.01)

(52) U.S. Cl.
CPC ..... *F42B 1/032* (2013.01); *F42B 1/036* (2013.01); *F42B 12/10* (2013.01)
USPC ..... 102/306; 102/307; 102/476

(58) Field of Classification Search
CPC ..... F42B 1/032
USPC ..... 102/306, 307, 476
See application file for complete search history.

(56) References Cited

U.S. PATENT DOCUMENTS

| | | | | |
|---|---|---|---|---|
| 6,588,344 | B2 * | 7/2003 | Clark et al. | 102/307 |
| 7,011,027 | B2 | 3/2006 | Reese et al. | |
| 7,712,416 | B2 | 5/2010 | Pratt et al. | |
| 2004/0255812 | A1 * | 12/2004 | Bourne et al. | 102/476 |
| 2007/0051267 | A1 | 3/2007 | Meddes et al. | |

FOREIGN PATENT DOCUMENTS

EP 0860679 8/1998

OTHER PUBLICATIONS

International Search Report and Written Opinion mailed on Aug. 23, 2013 for International Patent Application No. PCT/US2013/041039, filed on May 15, 2013, 12 pages.

* cited by examiner

*Primary Examiner* — Michael David
(74) *Attorney, Agent, or Firm* — Jeffery R. Peterson; Brandon S. Clark

(57) ABSTRACT

A liner for a shaped charge is provided for improved penetration of a target formation. The liner is formed from a combination of high density particulate and low density particulate.

13 Claims, 1 Drawing Sheet

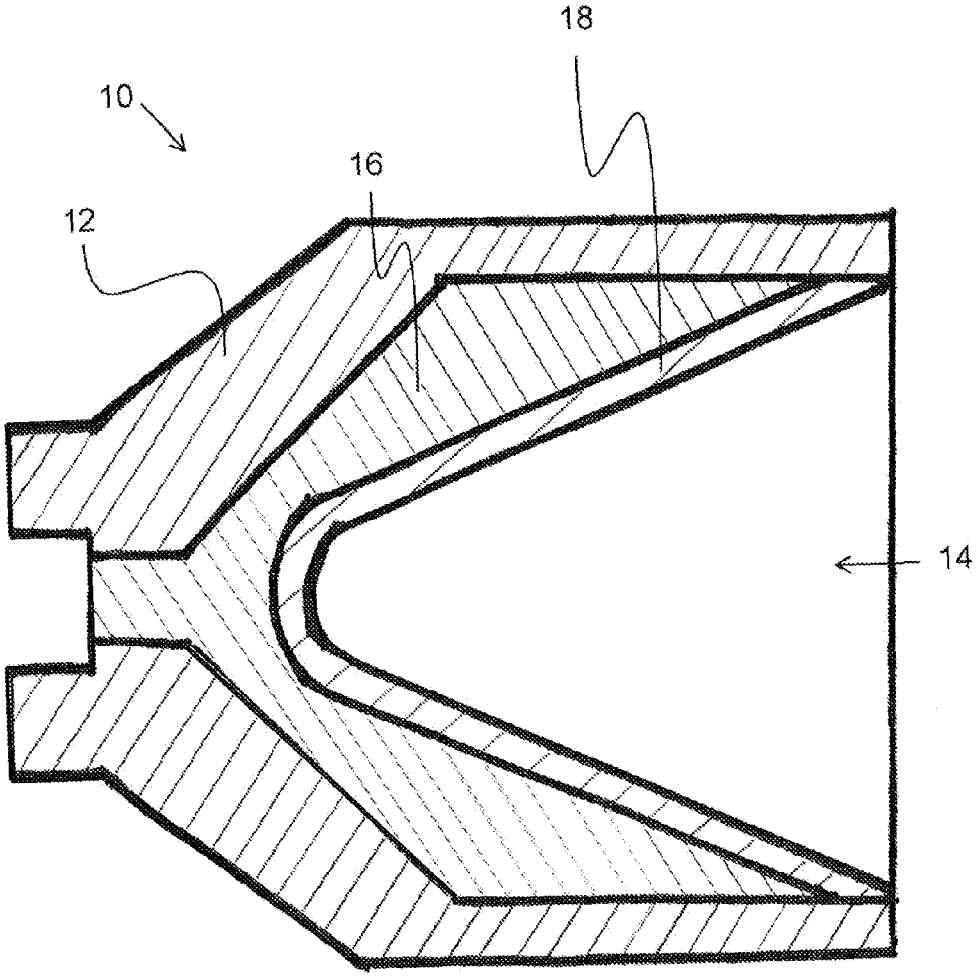
18
10
16
12
14

SHAPED CHARGE LINER

FIELD

The invention relates to shaped charges and, more particularly, to shaped charge liners.

BACKGROUND

In order to access hydrocarbon formations from a wellbore, perforating guns have been used to create opening tunnels from the wellbore into the hydrocarbon formation, through which the hydrocarbons can flow out to surface. Deeper tunnels increases the formation exposed to the tunnel and can result in increased productivity from the formation.

Perforating guns generally include a series of shaped charges connected to a detonation system. Each shaped charge generally includes a case, an explosive pellet inside the case, and a metallic cone shaped liner which covers the pellet and enhances penetration depth. The detonation of the explosive pellet generates high pressure gases which propel the liner to collapse at the center line and form a fast moving metallic jet. The tip of the jet can move at speeds of around seven kilometers per second and a tail of the jet in general moves at around one kilometer per second. The symmetry of the shaped charge (case, pellet and liner) affects its ability to form a coherent jet. Asymmetries of the shaped charge result in an incoherent jet which is detrimental to the penetration depth.

In oil filled down-hole applications, the intended target of the shaped charges is the rock formation. Rock formations can have varying strengths and be under varying levels of stress. In instances where the target has a high strength and is under a high stress, the target has a higher resistance to the jet resulting in a reduced penetration depth compared to targets having less strength or under less stress.

According to classical penetration theory, penetration depth (P) is proportional to the jet length (L) and the square root of the ratio of the jet material density ($\rho_{jet}$) and the tail material density (($\rho_{tail}$) as illustrated by formula I:

$$P = L\sqrt{\frac{\rho jet}{\rho target}}$$

As such, in order to achieve a deeper penetration, high density materials are utilized in liners. In oil field applications, shaped charge liners are made with powdered metals. The liner density is limited by the density of the commonly used materials, such as tungsten which has a density of 19.3 grams per cubic centimeter.

However, even with denser materials, such as tungsten, packing the powdered metal results in spaces or gaps between the particles which is filled by air, thereby reducing the overall density of the liner. To fill the voids between the tungsten, mixtures of copper (Cu) and lead (Pb) are usually used as a binding material. Both copper (density of 8.9 grams per cubic centimeter) and lead (11.3 grams per cubic centimeter) provide filler and are sufficiently dense so as to not significantly reduce that the overall density of the liner. For example, known commercial shaped charge liners have tungsten content up to 80% by weight, with a density of about 16.0 grams per cubic centimeter.

As shown in formula I, penetration depth is also proportional to the jet length. Generally, jet length is roughly proportional to the ratio of the velocity of the jet tip to the velocity of the tail of the jet. As such, if the jet's tip/tail velocity ratio is high, a deeper penetration depth can be achieved since the jet will stretch longer before it hits the target.

As previously indicated the symmetry of the shaped charge, especially the liner, affects penetration depth. Variations in wall thickness or geometry can have a deleterious effect on the resulting jet, in particular causing the jet to form away from the center line resulting in a jet which varies from a straight, predetermined course toward and into the target formation.

Another factor affect the effective depth of penetration is the slug portion of the jet, which moves slower (−500m/sec.) and is, in general, not capable of penetrating the formation rock. The slug, however, fills the bottom of the perforation tunnel and forms a tight plug. Due to its metallic nature, the slug is not permeable, and thus is it not easily cleaned out from the bottom of the perforation tunnel. As a result, the presence of the slug reduces the tunnel efficiency and thus leads to less productivity from the formation.

BRIEF DESCRIPTION OF THE DRAWING

FIG. 1 illustrates a shaped charge in accordance with an example embodiment.

DETAILED DESCRIPTION

A liner for a shaped charge is disclosed which provides increased penetration depth and a more stable charge performance. The liner is made from particulate material formed into a specific shape by known processes, such as pressing. The liner includes a high density particulate and a low density particulate. An embodiment includes, as shown in FIG. 1, a shaped charge 10 having a casing member 12, an opening 14 of the casing, an explosive component 16 positioned within the opening of the casing, and a liner member 18 positioned within the opening of the casing and against the explosive component such that the liner member extends across the opening and covers the explosive component. An example liner member includes a metallic particulate having a density of at least eight grams per cubic centimeter and providing from at least seventy percent up to ninety nine percent by weight of the liner and non-metallic particulate having a density of less than seven grams per cubic centimeter providing from at least one percent up to thirty percent by weight of the shaped charge liner member.

High density particulate includes known metallic particulate used in the production of liners for shaped charges. The metallic particulate has an average density of at least eight grams per cubic centimeter, in another embodiment at least ten grams per cubic centimeter, in another embodiment at least thirteen grams per cubic centimeter or in another embodiment at least fifteen grams per cubic centimeter. Commonly used metallic particulate includes tungsten (W), copper (Cu), lead (Pb), other metallic materials and combinations thereof.

Low density particulate includes material having an average density of less than seven grams per cubic centimeter, in another embodiment less than five grams per cubic centimeter, in another embodiment less than four grams per cubic centimeter or in another embodiment less than three grams per cubic centimeter. The low density particulate can include non-metallic materials such as SiC, $AL_2O_3$, $Si_3N_4$, ZnO, TiC, $SiO_2$, $B_4C$, $B_4N$, AN, $Mg_3N_2$, $Li_3N$, $TiO_2$, MgO, bauxite, diamond, hollow ceramic spheres and combinations thereof.

The high density particulate provides the bulk of the mass of the liner, from at least seventy percent to about ninety nine percent by weight, or from at least eighty percent to about ninety nine percent by weight, or about eighty percent by weight. The low density particulate fills the space between the high density particles so as to minimize any gaps or open areas within the liner. The low density particulate provides most, if not all of the remainder of the mass of the liner, from at least about one percent up to thirty percent by weight, or from at least about one percent up to twenty percent by weight, or about 20 percent by weight.

In another embodiment, the low density particulate can be coated with a malleable metal, such as copper, lead, tin, zinc or aluminum. The coated, low density particulate is then mixed with the high density particulate so that they can be easily bonded together.

The inclusion of the low density particulate, up to about thirty percent by weight, allows the liner to be made with a density less than eleven grams per cubic centimeter, or in another embodiment less than ten grams per cubic centimeter, or in another embodiment less than nine grams per cubic centimeter. As a result, the liner can be formed having the same geometry and size while being less massive, such as up to forty percent by weight less massive. The resulting lower mass liner allows for a higher jet velocity leading to deeper penetration in strong and stressed rock formations, resulting in increased well productivity. More particularly, although the average density of the liner is lower, the individual high density particles have the same density and mass but a higher speed. Therefore, the liner allows for additional target penetration distance compared to known liners.

Alternatively, a liner can be formed then with the same mass, but having a larger volume and, in particular, a thicker liner. As previously indicated, asymmetries of the shaped charge liner reduce the penetration distance. By providing a liner with thicker walls while maintaining the same mass, variances in wall thickness can be controlled and reduced thereby allowing the energy provided by the explosive in the shaped charge to be more efficiently transferred into providing a jet which travels directly to the target formation.

The adding of the non-metallic materials in the jet can reduce the tightness of the slug at the bottom of the perforating tunnel, so that it becomes permeable, thus leading to higher productivity which is equivalent to deeper penetration. In addition, the slug can be easily cleaned out using known methods, including processes such as Schlumberger's PURE technology.

While various embodiments have been described herein with respect to a limited number of examples, those skilled in the art, having benefit of this disclosure, will appreciate that other embodiments and variations thereof can be devised which do not depart from the scope disclosed herein. Accordingly, the scope of the claims should not be unnecessarily limited by the present disclosure.

What is claimed is:

1. A powdered metal shaped charge liner comprising:

metallic particulate having a density of at least eight grams per cubic centimeter and providing from at least seventy percent up to ninety nine percent by weight of the shaped charge liner; and non-metallic particulate having a density of less than seven grams per cubic centimeter providing from at least one percent up to thirty percent by weight of the shaped charge liner, wherein the non-metallic particulate is selected from the group consisting of SiC, $AL_2O_3$, $Si_3N_4$, ZnO, TiC, $SiO_2$, $B_4C$, $B_4N$, AlN, $Mg_3N_2$, $Li_3N$, $TiO_2$, MgO, bauxite, Zeeospheres, diamond and combinations thereof.

2. The liner of claim 1 wherein the non-metallic particulate has a density of less than five grams per cubic centimeter.

3. The liner of claim 2 wherein the non-metallic particulate has a density of less than four grams per cubic centimeter.

4. The liner of claim 1 including a metallic coating disposed about each of the non-metallic particles.

5. The liner of claim 4 wherein the metallic coating includes lead.

6. The liner of claim 4 wherein the metallic coating includes copper, Tin, Zinc, Aluminum.

7. The liner of claim 1 wherein the density of the metallic particulate is at least thirteen grams per cubic centimeter.

8. The liner of claim 1 wherein the density of the metallic particulate is at least fifteen grams per cubic centimeter.

9. The liner of claim 7 including a density of the liner of less than ten grams per cubic centimeter.

10. The liner of claim 1 wherein the metallic particulate is tungsten.

11. The liner of claim 1 wherein the metallic particulate is selected from the group consisting of tungsten, copper, lead and combinations thereof.

12. A shaped charge comprising:

a casing member;

an opening of the casing;

an explosive component positioned within the opening of the casing;

a liner member positioned within the opening of the casing and against the explosive component such that the liner member extends across the opening and covers the explosive component;

metallic particulate of the liner having a density of at least eight grams per cubic centimeter and providing from at least seventy percent up to ninety nine percent by weight of the liner; and non-metallic particulate of the liner having a density of less than seven grams per cubic centimeter providing from at least one percent up to thirty percent by weight of the shaped charge liner, wherein the non-metallic particulate is selected from the group consisting of SiC, $AL_2O_3$, $Si_3N_4$, ZnO, TiC, $SiO_2$, $B_4C$, $B_4N$, AlN, $Mg_3N_2$, $Li_3N$, $TiO_2$, MgO, bauxite, Zeeospheres, diamond and combinations thereof.

13. A powdered metal shaped charge liner comprising:

metallic particulate having a density of at least eight grams per cubic centimeter and providing from at least seventy percent up to ninety nine percent by weight of the shaped charge liner; and non-metallic particulate having a density of less than seven grams per cubic centimeter providing from at least one percent up to thirty percent by weight of the shaped charge liner, wherein the non-metallic particulate has a metallic coating.

* * * * *